US008465399B2

(12) United States Patent
Tommy, Jr. et al.

(10) Patent No.: US 8,465,399 B2
(45) Date of Patent: Jun. 18, 2013

(54) EXERCISE PLATFORM WITH ANGLED STEPS

(75) Inventors: Moring Tommy, Jr., San Marcos, CA (US); Michael Cummings, San Marcos, CA (US); David Wilber, Carlsbad, CA (US)

(73) Assignee: Michael Cummings, San Marcos, CA (US)

( * ) Notice: Subject to any disclaimer, the term of this patent is extended or adjusted under 35 U.S.C. 154(b) by 0 days.

(21) Appl. No.: 13/299,606

(22) Filed: Nov. 18, 2011

(65) Prior Publication Data

US 2012/0065033 A1 Mar. 15, 2012

Related U.S. Application Data

(60) Division of application No. 12/470,458, filed on May 21, 2009, now Pat. No. 8,062,189, and a continuation-in-part of application No. 12/250,782, filed on Oct. 14, 2008, now abandoned.

(60) Provisional application No. 61/054,843, filed on May 21, 2008.

(51) Int. Cl.
*A63B 23/04* (2006.01)
*A63B 22/04* (2006.01)

(52) U.S. Cl.
USPC ..... 482/53; 482/142

(58) Field of Classification Search
USPC ..... 482/51–53, 148, 79–80
See application file for complete search history.

(56) References Cited

U.S. PATENT DOCUMENTS

| | | | | | |
|---|---|---|---|---|---|
| 4,483,531 | A * | 11/1984 | Laseman et al. | ..... | 482/27 |
| 4,730,826 | A * | 3/1988 | Sudmeier | ..... | 482/71 |
| 4,772,014 | A * | 9/1988 | Rebman | ..... | 482/51 |
| 4,824,100 | A * | 4/1989 | Hall et al. | ..... | 482/28 |
| 5,076,571 | A * | 12/1991 | Croce et al. | ..... | 472/90 |
| 5,162,028 | A * | 11/1992 | Wilkinson | ..... | 482/52 |
| 5,232,420 | A * | 8/1993 | Terauds | ..... | 482/53 |
| 5,234,396 | A * | 8/1993 | Wilkinson | ..... | 482/142 |
| 5,318,489 | A * | 6/1994 | Irwin | ..... | 482/52 |
| 5,474,509 | A * | 12/1995 | Hodgdon | ..... | 482/52 |
| 5,547,460 | A * | 8/1996 | Ishikawa | ..... | 601/23 |
| 5,558,603 | A * | 9/1996 | Simon | ..... | 482/52 |
| 5,584,779 | A * | 12/1996 | Knecht et al. | ..... | 482/8 |
| 5,651,753 | A * | 7/1997 | Wilkinson | ..... | 482/52 |
| 5,879,272 | A * | 3/1999 | Mekjian | ..... | 482/51 |
| 5,947,870 | A * | 9/1999 | Hall et al. | ..... | 482/27 |
| 6,162,061 | A * | 12/2000 | Taylor | ..... | 434/253 |
| 6,206,805 | B1 * | 3/2001 | Helton et al. | ..... | 482/52 |

(Continued)

*Primary Examiner* — Stephen Crow
(74) *Attorney, Agent, or Firm* — Torrey Pines I.P. Group, P.C.

(57) ABSTRACT

An exercise platform system and apparatus is disclosed that includes a plurality of angled step surfaces. In one aspect, the exercise platform can include an exercise platform base adapted to interface with a supporting surface and an exercise platform upper surface coupled to the exercise platform base that includes a first step having a first step surface, a second step having a second step surface, and a center landing area located between the first step and the second step, the center landing area being substantially parallel to the exercise platform base, wherein the first step surface and the second step surface are angled toward the center landing area by an angle between 5 and 30 degrees, inclusive. Further, the first step surface and the second step surface can be angled by a second angle between 5 and 30 degrees toward a transverse axis laterally bisecting the exercise platform base.

7 Claims, 6 Drawing Sheets

U.S. PATENT DOCUMENTS

| | | | | |
|---|---|---|---|---|
| 6,908,414 | B1 * | 6/2005 | Roadman | 482/51 |
| 6,926,643 | B1 * | 8/2005 | Gvoich | 482/52 |
| 7,052,449 | B2 * | 5/2006 | Chen | 482/146 |
| 7,104,901 | B1 * | 9/2006 | Mason | 473/446 |
| 7,261,679 | B2 * | 8/2007 | Sload | 482/124 |
| 7,520,840 | B2 * | 4/2009 | Shifferaw | 482/52 |
| 7,601,107 | B2 * | 10/2009 | Maloy et al. | 482/123 |
| 7,666,128 | B2 * | 2/2010 | Hubbard et al. | 482/148 |
| 7,762,928 | B2 * | 7/2010 | Meissner | 482/37 |
| 7,833,131 | B2 * | 11/2010 | Rote | 482/27 |
| 8,062,189 | B1 * | 11/2011 | Moring et al. | 482/53 |
| 2009/0264265 | A1 * | 10/2009 | Contreras | 482/99 |
| 2012/0202652 | A1 * | 8/2012 | Ross | 482/52 |

* cited by examiner

EXERCISE PLATFORM WITH ANGLED STEPS

CROSS-REFERENCE TO RELATED APPLICATIONS

This application is a divisional of U.S. patent application Ser. No. 12/470,458, filed May 21, 2009, entitled "Exercise Platform With Angled Step Surfaces" which was a continuation-in-part of U.S. patent application Ser. No. 12/250,782 filed on Aug. 6, 2008, entitled "Step Exercise and Physical Therapy Device," and also claims priority to U.S. Provisional Application Ser. No. 61/054,843 filed May 21, 2008, entitled "Step Exercise and Physical Therapy Device," the disclosures of which are considered part of and are incorporated by reference in the disclosure of this application.

TECHNICAL FIELD

The present disclosure relates to an exercise platform that includes a plurality of angled step surfaces, and to methods for using the exercise platform, such as for physical therapy or conditioning.

BACKGROUND

Raised benches simulating a step have been used for exercise, such as cardiovascular training. For example, a raised bench or other such flat platform has been used in performing repetitive stepping exercises. Step exercise programs have been designed to utilize the entire stepping surface, length and width, of a raised bench. For example, users are instructed to step onto and off of the raised bench repeatedly during an exercise session, often in different directions across the upper surface of the bench.

The difficulty of a stepping exercise program further can be increased by raising the height of the bench. Detachable risers have been developed for use in altering the height of the raised bench, such as during different phases of an exercise program. In order to provide for greater customization, the detachable risers can be of varying height or can be combined. However, matched risers are employed to ensure that the top surface of the raised bench remains level. Thus, a broad, level stepping surface is provided for the user.

Machines also have been developed for performing leg strengthening exercises, such as squats. The machines typically have a padded surface that contacts the user's shoulders and/or back. Further, resistance can be selectively provided through a weight stack or individual weights secured to the machine. The machines also include a level platform on which a user can stand.

SUMMARY

This specification describes an exercise platform for conditioning, rehabilitating, and/or building muscles and connective tissue. Through use of the exercise platform, muscles, muscle groups, and related tissues can be developed evenly and symmetrically. The exercise platform includes a pair of opposing step surfaces that are at least partially angled toward each other. For example, opposing left and right step surfaces each can be angled toward the center of the exercise platform. Further, the left and right step surfaces can be angled toward the center of the exercise platform by substantially the same degree, such as any angle between 5 and 30 degrees, inclusive. Additionally, the left and right step surfaces each can be angled such that at least a portion of the front of the step surface is at a different elevation than at least a portion of the back of the step surface. For example, a step surface can be configured such that the back of a user's foot is positioned lower than the front of the user's foot. In some implementations, the left and right step surfaces can be detachably coupled to one another, such as through a connector.

The present inventors recognized a need to include one or more additional step surfaces on the exercise platform, such as either or both of a front step surface and a back step surface. Further, the present inventors recognized a need to permit angling one or more of the additional step surfaces in at least one dimension. In order to facilitate portability of the exercise platform, the present inventors recognized that it would be beneficial to construct the exercise platform from a rigid and lightweight material.

The present inventors also recognized a need to permit including one or more hook points (or anchor points) for securing resistance members, such as elastic bands. Further, the present inventors recognized a need to permit reversing (or inverting) the platform to provide a single, continuous step surface. Accordingly, the exercise platform described here can be configured such that opposing left and right step surfaces are arranged to align a user to have a full range of motion for one or more muscles through a variety of exercises, including squatting exercises.

In general, in one aspect, the subject matter can be implemented as an exercise platform including an exercise platform base configured to interface with a supporting surface; a first step coupled to the exercise platform base including a first step surface angled between 5 and 30 degrees toward a longitudinal axis bisecting the exercise platform base; and a second step coupled to the exercise platform base including a second step surface angled toward the longitudinal axis of the exercise platform base by an amount substantially equal to the angle of the first step surface; wherein the angle of the first step surface and the second step surface is measured with respect to a plane that is substantially parallel to the exercise platform base.

The subject matter also can be implemented such that the first step surface and the second step surface are angled by a second angle between 5 and 30 degrees toward a transverse axis laterally bisecting the exercise platform base. Further, the subject matter can be implemented to include a front step coupled to the exercise platform base, including a front step surface angled between 5 and 30 degrees toward a transverse axis laterally bisecting the exercise platform base. Additionally, the subject matter can be implemented to include a back step coupled to the exercise platform base, including a back step surface angled between 5 and 30 degrees toward a transverse axis laterally bisecting the exercise platform base.

The subject matter also can be implemented to include a center landing area located between the first step and the second step, wherein the center landing area is substantially parallel to the exercise platform base. Further, the subject matter can be implemented to include a hook point adapted to receive a resistance member. Additionally, the subject matter can be implemented to include a plurality of grounding points distributed on an exercise platform upper surface coupled to the exercise platform base.

The subject matter also can be implemented such that the first and second step surfaces include a non-slip covering. Further, the subject matter can be implemented such that the first and second step surfaces are molded to include non-slip surface features.

In general, in another aspect, the subject matter can be implemented as an exercise platform including an exercise platform base adapted to interface with a supporting surface and an exercise platform upper surface coupled to the exercise platform base that includes a first step having a first step surface; a second step having a second step surface; and a center landing area located between the first step and the second step, the center landing area being substantially parallel to the exercise platform base; wherein the first step surface and the second step surface are angled toward the center landing area by an angle between 5 and 30 degrees.

The subject matter also can be implemented such that the exercise platform upper surface is further configured to include a front step having a front step surface angled toward the center landing area by an angle between 5 and 30 degrees. Further, the subject matter can be implemented such that the exercise platform upper surface is further configured to include a back step having a back step surface angled toward the center landing area by an angle between 5 and 30 degrees. Additionally, the subject matter can be implemented such that the first step surface and the second step surface are angled by a second angle between 5 and 30 degrees toward a transverse axis laterally bisecting the exercise platform base.

The subject matter also can be implemented such that an angled landing surface is coupled to each of the first step surface and the second step surface. Further, the subject matter can be implemented such that the exercise platform upper surface is further configured to include a hook point adapted to receive a resistance member. Additionally, the subject matter can be implemented such that the exercise platform upper surface is further configured to include a fastener adapted to receive a resistance member, the fastener being detachably coupled to the exercise platform upper surface.

The subject matter also can be implemented such that the exercise platform upper surface is further configured to include a plurality of grounding points having skid-resistant elements. Further, the subject matter can be implemented such that the first and second step surfaces include a non-slip covering. Additionally, the subject matter can be implemented such that the first and second step surfaces are molded to include non-slip surface features. The subject matter also can be implemented such that the exercise platform base and the exercise platform upper surface are comprised of high-density polyethylene.

Particular embodiments of the subject matter described in this specification can be implemented to realize one or more of the following advantages. For example, the subject matter can be implemented to permit a user to perform a variety of exercises that cause one or more muscles, e.g., the quadriceps, to be worked through a complete range of motion. The subject matter also can target specific muscles or muscle groups. Additionally, the subject matter can be implemented to accommodate relative differences in muscle strength, such as by aligning the body to use specific muscle groups at specific points in an exercise.

Further, the subject matter can be implemented such that the exercise platform can be reversed to expose a single, continuous step surface. The subject matter also can be implemented to permit increasing the resistance experienced by a user by attaching one or more resistance members to corresponding hook points of the exercise platform. Additionally, the subject matter can be implemented to provide accurate anatomical ergonomics to reduce side-to-side friction on the knee during exercise. For example, the angled step surfaces can be configured to set the spine and knees in proper functional alignment. The subject matter also can be implemented to strengthen the inner thigh muscles, including the vastus medialis, during exercise to reduce the incidence of patellar dislocation.

This subject matter can be implemented in an apparatus or a system. The details of one or more embodiments of the invention are set forth in the accompanying drawings and the description below. Other features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
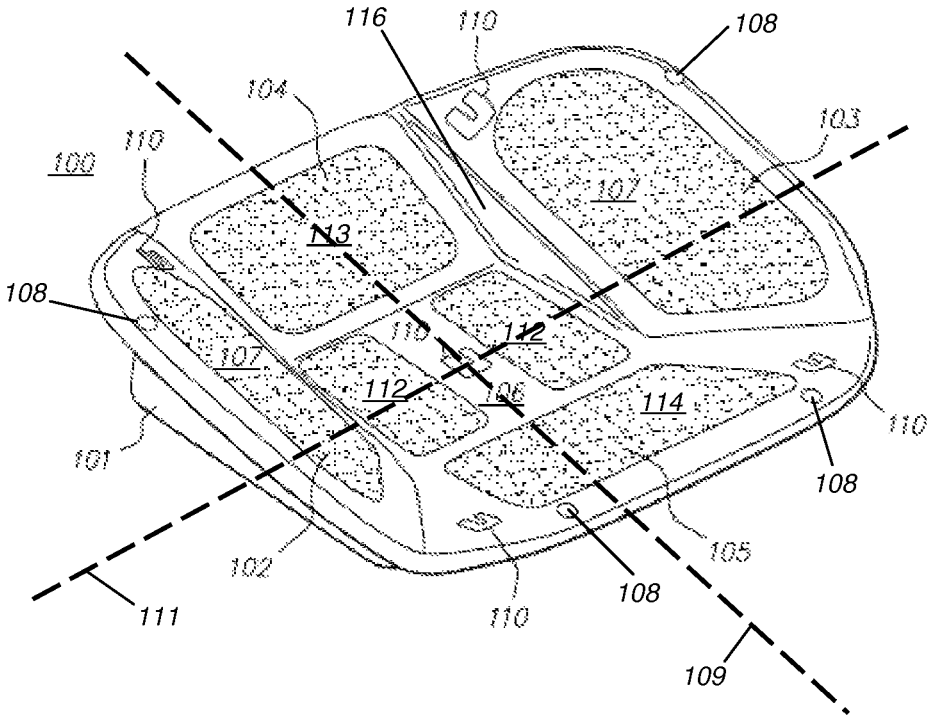
FIG. 1 shows an exemplary exercise platform that includes a plurality of angled step surfaces.
Figure 2:
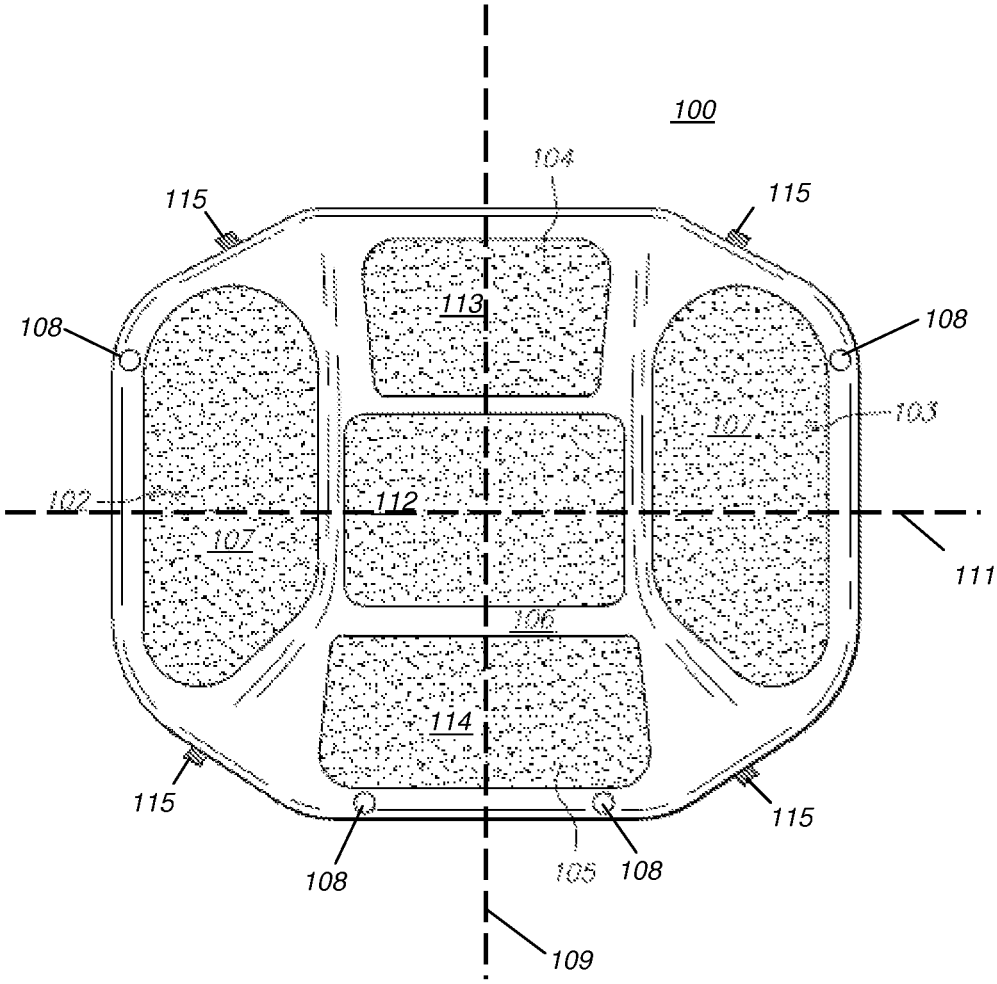
FIG. 2 shows a top view of an exemplary exercise platform that includes a plurality of angled step surfaces.

FIGS. 1 and 2 show an exemplary exercise platform 100 that includes a plurality of angled step surfaces. The exercise platform 100 can be manufactured from a lightweight and rigid material, e.g., high-density polyethylene, capable of supporting an adult user during exercise. For example, the exercise platform 100 can be constructed to support a 250 pound user. Different implementations of the exercise platform 100 can be constructed to support different weights. Further, the exercise platform 100 can be constructed as a single piece or can be assembled from multiple pieces. For example, the exercise platform 100 can include an upper portion including one or more step surfaces and a lower portion configured to serve as a foundation for the upper portion and to interface with a supporting surface, such as a floor. Additionally, one or more components of the exercise platform 100 can be manufactured through a molding process, such as injection molding or rotational molding.

The exercise platform 100 includes a base 101, which is configured to rest on a support surface, such as a floor. In some implementations, the base 101 can be formed as a flat, continuous panel. In such implementations, the exercise platform 100 also can be inverted to use the base 101 as a uniform stepping surface. The base 101 can include a slip resistant surface or slip resistant elements to provide for better adhesion to the support surface and to provide improved traction for a user when the exercise platform 100 is inverted. Further, grounding points 108 (or feet) can be included on the upper surface of the exercise platform 100 to protect the exercise platform 100 when it is inverted. The grounding points 108 can be raised and can be constructed of or at least partially covered by a slip resistant material, such as rubber, to secure the exercise platform to the support surface. In some other implementations, the base 101 can be formed using one or more support elements, e.g. rails, legs, or other such extensions and/or protrusions. In such implementations, one or more slip resistant surfaces can be included on the support elements forming the base 101 to provide for better adhesion to the support surface.

The base 101 also can be adapted to facilitate additional uses. In some implementations, the base 101 can be configured to mate with a balancing element (not shown) to permit the exercise platform 100 to be used for balance training. For example, the balancing element can be coupled with the base 101 in either a fixed or a movable relationship, such that the exercise platform 100 can move in at least one dimension with respect to the support surface on which it is placed. The balancing element can be coupled to the base using any technique known in the art, including in a ball-and-socket relationship or by being slotted into a track.

A left step 102 and a right step 103 also can be included on the exercise platform 100. The left step 102 and the right step 103 can be configured as mirror images, such that each is angled in by the same amount toward a longitudinal axis 109 that bisects the exercise platform 100 longitudinally. The upper surface of the left step 102 and the right step 103 can be angled by any amount between 5 and 30 degrees, inclusive of 5 and 30 degrees. Thus, both the left step 102 and the right step 103 are angled in toward the center of the exercise platform 100 by substantially the same amount. A difference between the angle of the left step 102 and the right step 103 of no more than 3 degrees is considered to be substantially the same amount. The degree of angle is measured with respect to a plane that is parallel to the bottom of the base 101. For example, the upper surface of the left step 102 and the upper surface of the right step 103 each can be angled at 25 degrees toward the longitudinal axis 109 of the exercise platform 100.

In some implementations, the left step 102 and the right step 103 also can be angled with respect to a transverse axis 111 that bisects the exercise platform 100 laterally. The left step 102 and the right step 103 can be angled in the same direction and by substantially the same amount with respect to the transverse axis 111, thus creating a forward-leaning or backward-leaning angle. For example, the left and right steps 102, 103 can be angled such that the front portion of each step is higher than the back portion, e.g., to create a backward-leaning or heel-down position. Further, the upper surface of the left and right steps 102, 103 can be angled with respect to the transverse axis 111 by any amount between 5 and 30 degrees, inclusive, as measured with respect to a plane that is parallel to the bottom of the base 101. A difference between the angle of the left step 102 and the right step 103 of no more than 3 degrees is considered to be substantially the same amount. Although a step surface can be angled with respect to either or both of the longitudinal axis 109 and the transverse axis 111, the step surface need not be rotated about the corresponding axis.

Additionally, the left step 102 and the right step 103 each can include a landing surface 107 sized to accommodate at least one of a user's feet. For example, the landing surface 107 can be approximately 12 inches wide and 20 inches long. Further, the landing surface 107 can possess a high coefficient of friction. In some implementations, the landing surface 107 can include a slip resistant covering or coating, such as a rubber pad. In some other implementations, the landing surface 107 can be molded to include surface features designed to render the surface slip resistant. In still other implementations, the landing surface can include both a slip resistant covering and slip resistant surface features.

The exercise platform 100 also can include one or more of a front step 104, a back step 105, and a center landing area 106. The front step 104 can be angled in toward the transverse axis 111. The angle of the upper surface of the front step 104 can be any amount between 5 and 30 degrees, as measured with respect to a plane that is parallel to the bottom of the base 101. The degree of angle of the front step 104 can be selected independently of the degree of angle of any other step on the exercise platform 100. For example, the upper surface of the front step 104 can have an angle of 30 degrees. In some implementations, the front step 104 also can be angled with respect to the longitudinal axis 109. For example, the upper surface of the front step 104 can be angled such that the center of the front step 104 is slightly lower or higher than the edges of the front step 104 neighboring the left and right steps 102, 103.

The back step 105 also can be angled toward the transverse axis 111. The angle of the upper surface of the back step 105 can be any amount between 5 and 30 degrees as measured with respect to a plane that is parallel to the bottom of the base 101. The degree of angle of the back step 105 also can be selected independently of the degree of angle of any other step on the exercise platform 100. For example, the upper surface of the back step 105 can be angled at 20 degrees. In some implementations, the back step 105 also can be angled with respect to the longitudinal axis 109. For example, the upper surface of the back step 105 can be angled such that the center of the back step 105 is slightly lower or higher than the edges of the back step 105 neighboring the left and right steps 102, 103.

The front step 104 and the back step 105 further can include landing surfaces 113 and 114, respectively, sized to accommodate at least one of a user's feet. The landing surfaces 113 and 114 can be independently sized with respect to length and/or width. For example, the landing surface 113 can be approximately 14 inches wide and 10 inches long, and the landing surface 114 can be approximately 20 inches wide and 10 inches long. Further, the landing surfaces 113 and 114 also can possess a high coefficient of friction, such as through a covering, molded surface features, or both.

The center landing area 106 can provide a rest area in which the user can stand, such as while stepping onto or off of the exercise platform 100. The center landing area 106 can include one or more landing surfaces 112, each of which is sized to accommodate at least one of a user's feet. For example, the center landing area 106 can include two landing surfaces 112, each of which can be approximately 5 inches wide and 12 inches long. In some implementations, the center landing area 106 can be configured to be substantially parallel to the underlying support surface. In some other implementations, the upper surface of the center landing area 106 can be angled with respect to the longitudinal axis 111, such as at an angle between 1 and 10 degrees with respect to the plane that is parallel to the bottom of the base 101. The exercise platform 100 also can include a face 116 where a step, such as the left step 102, intersects with the center landing area 106 and/or another step. As a result, a step can be raised above and thus separated from another surface of the exercise platform 100, such as the center landing area 106.

The exercise platform 100 also can include one or more hook points 110 for securing resistance members, such as elastic bands or elastic tubing. The resistance members can be used during exercise to increase the resistance experienced by the user. Further, the resistance members can provide differing amounts of resistance and can be used individually or in combination to provide the desired amount of resistance. The one or more hook points 110 can be arranged on the upper surface of the exercise platform 100 in any configuration, such as in accordance with a predetermined exercise program. In some implementations, the one or more hook points 110 can be integrated with the exercise platform 100. For example, a hook point 110 can be cut into or formed in the surface of the exercise platform 100 so that an opening provides access to a securing structure, such as a pin, a hook, a bar, a clip, a clamp, or other such device. In some other implementations, one or more fasteners 115 can be used in place of or in addition to the one or more hook points 110. The fasteners 115 also can be included on the surface of the exercise platform 100, including on the periphery, in fixed or selectable locations. For example, a fastener 115 can be removably coupled to the exercise platform 100, such as through a pin or by inserting it into a slot, track, or other such receptacle. The fastener 115 can be repositioned to any other position on the exercise platform 100 that is configured to receive the fastener 115.

In some implementations, the angle of each step and landing surface included on the exercise platform 100 can be configured at the time of manufacture, such that the angles are fixed and unalterable. A variety of exercise platforms can be manufactured, featuring any combination of angled step surfaces. In other implementations, the angle of one or more of the steps and/or landing surfaces can be altered or reconfigured after manufacture. For example, an angled landing surface attachment can be permanently or detachably coupled to a step surface after manufacture to alter the degree of angle. A variety of angled landing surface attachments can be provided to cover a range of angles, such as 5 to 30 degrees. In some implementations, two or more angled landing surface attachments can be combined to form a different angle. Thus, the angle of one or more steps included on the exercise platform 100 can be customized to accommodate a particular user.

Figure 3:
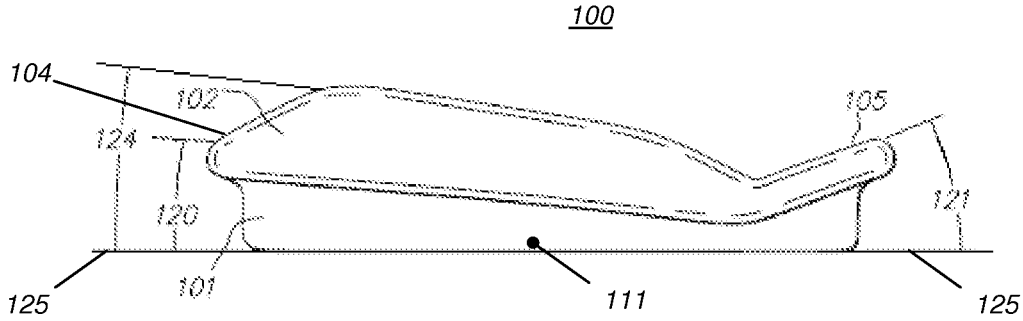
FIG. 3 shows a side view of an exemplary exercise platform that includes a plurality of angled step surfaces.

FIG. 3 shows a side view of an exemplary exercise platform 100 that includes a plurality of angled step surfaces. The degree of angle for a step of the exercise platform 100 can be measured with respect to a plane 125 running parallel to the bottom of the base 101. The plane 125 interfaces with the bottom of the base 101 in the same manner as a support surface upon which the exercise platform 100 is placed, such as a floor. The front step angle 120 indicates the degree by which the upper surface of the front step 104 is angled inward toward the exercise platform 100 with respect to the transverse axis 111. Similarly, the back step angle 121 indicates the degree by which the upper surface of the back step 105 is angled inward toward the exercise platform 100 with respect to the transverse axis 111. The degree of angle of both the front and back steps 104, 105 is measured with respect to the plane 125. Further, each of the front step 104 and the back step 105 can be angled independently of the angle of any other step on the exercise platform 100, such that the degree by which the upper surface of the front step 104 is angled can differ from the degree by which the upper surface of the back step 105 is angled.

The longitudinal angle 124 indicates the degree by which the upper surface of the left step 102 is angled with respect to the transverse axis 111. The longitudinal angle 124 can be measure from any location on the upper step surface, such as the exterior edge, the center, or the interior edge. The upper surface of the right step 103 (not shown) also is angled with respect to the transverse axis 111 by the longitudinal angle 124. Thus, a user's left foot and right foot can be positioned in a consistent manner, such as with a heel-down orientation.

Figure 4:
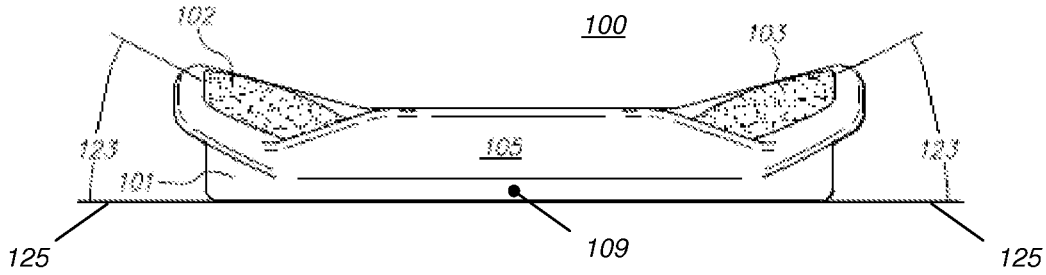
FIG. 4 shows a back view of an exemplary exercise platform that includes a plurality of angled step surfaces.

FIG. 4 shows a back view of an exemplary exercise platform that includes a plurality of angled step surfaces. The transverse angle 123 indicates the degree by which the upper surfaces of the left step 102 and the right step 103 are angled in toward the exercise platform 100 with respect to the longitudinal axis 109. As discussed above with respect to FIGS. 1 and 2, the left step 102 and the right step 103 are configured as minor images with respect to the longitudinal axis 109. Thus, a user's left foot and right foot can be positioned in a consistent manner, such that the sole of each foot is oriented away from the longitudinal axis 109.

Figure 5A:
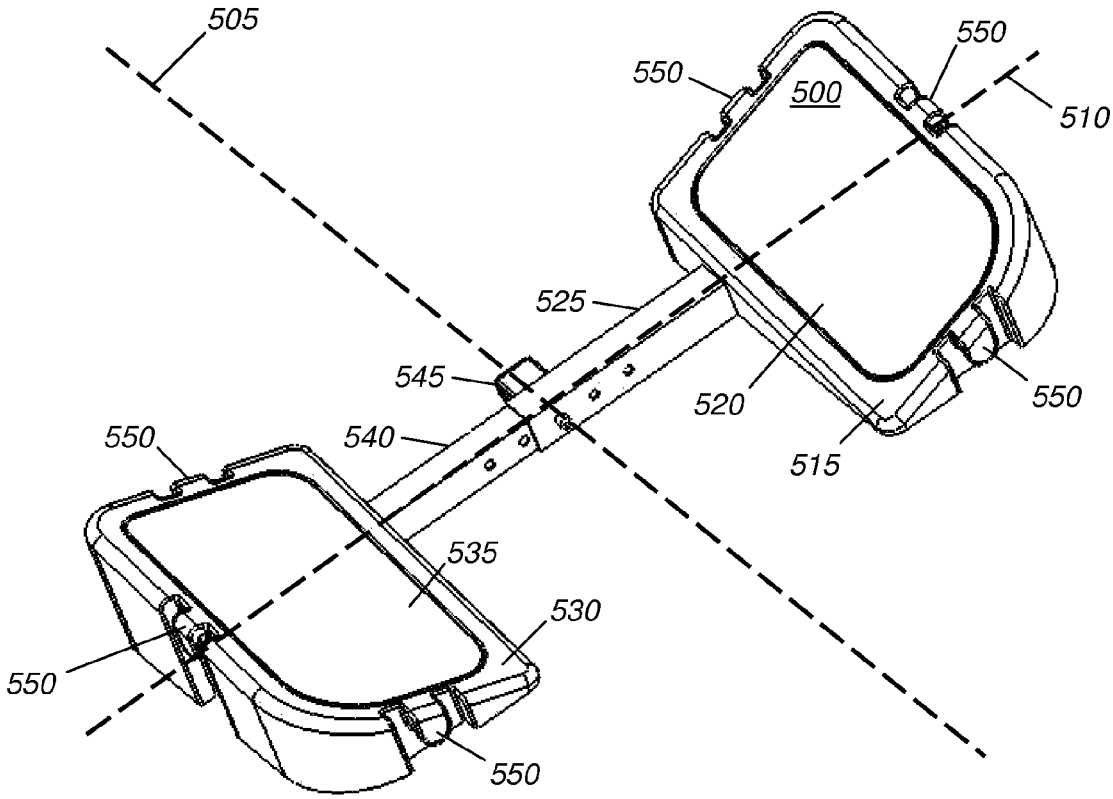
FIGS. 5A and 5B show an exemplary exercise platform that includes a plurality of angled step surfaces with adjustable width.

FIG. 5A shows a top view of an exemplary exercise platform 500 that includes a plurality of angled step surfaces with adjustable width. The exercise platform 500 can include a right step 515 and a left step 530, which can be manufactured from a lightweight and rigid material, e.g., high-density polyethylene, capable of supporting an adult user during exercise. For example, the exercise platform 500 can be constructed to support up to a 300 pound user. Different implementations of the exercise platform 500 can be constructed to support different weights. Further, the right step 515 and the left step 530 of the exercise platform 500 each can be constructed as a single piece or can be assembled from multiple pieces.

The right step 515 and the left step 530 of the exercise platform 500 each can include a base, which is configured to rest on a support surface, such as a floor. In some implementations, the base can be formed as a flat, continuous panel. In other implementations, the base can include one or more grounding points, edges, or supporting structures. The right step 515 and left step 530 also can be solid, hollow, or formed to include one or more support elements. Additionally, the base can include one or more skid resistant elements to increase friction between the exercise platform 500 and the support surface.

The right step 515 and the left step 530 also can be configured as mirror images, such that each is angled in by the same amount toward a longitudinal axis 505 that bisects the exercise platform 500 longitudinally. The upper surface of the right step 515 and the upper surface of the left step 530 each can be angled by any amount between 5 and 30 degrees, inclusive. Thus, the upper surfaces of both the right step 515 and the left step 530 are angled toward each other by substantially the same amount. A difference between the angle of the left step 530 and the right step 515 of no more than 3 degrees is considered to be substantially the same amount. The degree of angle of the upper surface of the right and left steps 515, 530 is measured with respect to a plane that is parallel to the bottom of the base of the step. For example, the upper surface of the right step 515 and the upper surface of the left step 530 each can be angled at 25 degrees toward the longitudinal axis 505 of the exercise platform 500.

In some implementations, an upper surface of the right step 515 and the left step 530 also can be angled with respect to a transverse axis 510 that laterally bisects the exercise platform 500. The upper surface of the right step 515 and the left step 530 can be angled in the same direction and by substantially the same amount with respect to the transverse axis 510, thus creating a forward-leaning or backward-leaning angle. For example, the upper surface of the right and left steps 515, 530 can be angled such that the front portion of each step is higher than the corresponding back portion, e.g., to create a backward-leaning or heel-down position. Further, the upper surface of the right and left steps 515, 530 can be angled with respect to the transverse axis 510 by any amount between 5 and 30 degrees, inclusive, as measured with respect to a plane that is parallel to the bottom of the base of the corresponding step. A difference between the angle of the left step 530 and the right step 515 of no more than 3 degrees is considered to be substantially the same amount. Although a step surface can be angled with respect to either or both of the longitudinal axis 505 and the transverse axis 510, the step surface need not be rotated about the corresponding axis.

Additionally, the right step 515 can include a right landing surface 520 sized to accommodate at least one of a user's feet. Similarly, the left step 530 can include a left landing surface 535 sized to accommodate at least one of a user's feet. For example, the right landing surface 520 and left landing surface 535 each can be approximately 12 inches wide and 20 inches long. Further, the right and left landing surfaces 520, 535 can include a material characterized by a high coefficient of friction. In some implementations, the right and left landing surfaces 520, 535 can include a slip resistant covering or coating, such as a rubber pad. In some other implementations, the right and left landing surfaces 520, 535 can be molded to include surface features designed to render the surface slip resistant. In still other implementations, the right and left landing surfaces 520, 535 can include both a slip resistant covering and slip resistant surface features.

A right connector bar 525 can be fixedly or detachably coupled to the right step 515. The right connector bar 525 can be manufactured from a rigid material, such as high-density polyethylene, steel, or aluminum. For example, the connector bar can be a telescoping square box tube. In some implementations, the right connector bar 525 can include one or more holes 527 configured to receive a fastener, such as an anchor pin. In some other implementations, the right connector bar 525 can include notches or teeth configured to mate with either or both of an additional connector bar and a fastener. Further, a left connector bar 540 can be fixedly or detachably coupled to the left step 530. The left connector bar 540 can be manufactured from the same or similar materials as the right connector bar 525 and also can include one or more holes 547, notches, or teeth. The left connector bar 540 also can be configured to mate with the right connector bar 525. In some implementations, the left connector bar 540 can fit inside of or receive the right connector bar 525. Additionally, an anchor pin 545 can be inserted through holes 527, 547 in the right and left connector bars 525, 540, respectively, to secure the connector bars and the corresponding right and left steps 515, 530. In some other implementations, a different fastener, e.g. a clamp, can be used to join the right and left connector bars 525, 540. The relationship between the right and left connector bars 525, 540 also can be adjusted to vary the distance between the right step 515 and the left step 530. For example, the amount by which the left connector bar 540 is inserted into the right connector bar 525 can be increased to reduce the distance between the right and left steps 515, 530.

The anchor pin 545 also can be configured to include a hook point adapted to receive a resistance member. Further, one or more hook points 550 can be arranged on either or both of the right step 515 and the left step 530. The one or more hook points 550 can be arranged in any configuration, such as in accordance with a predetermined exercise program. In some implementations, the one or more hook points 550 can be integrated with the exercise platform 500. For example, a hook point 550 can be cut into or formed in the surface of a step forming the exercise platform 500, so that an opening provides access to a securing structure, such as a pin, a hook, a bar, a clip, a clamp, or other such device. In some other implementations, the one or more hook points 550 can be formed to include a protrusion to which a resistance member can be secured.

Figure 5B:
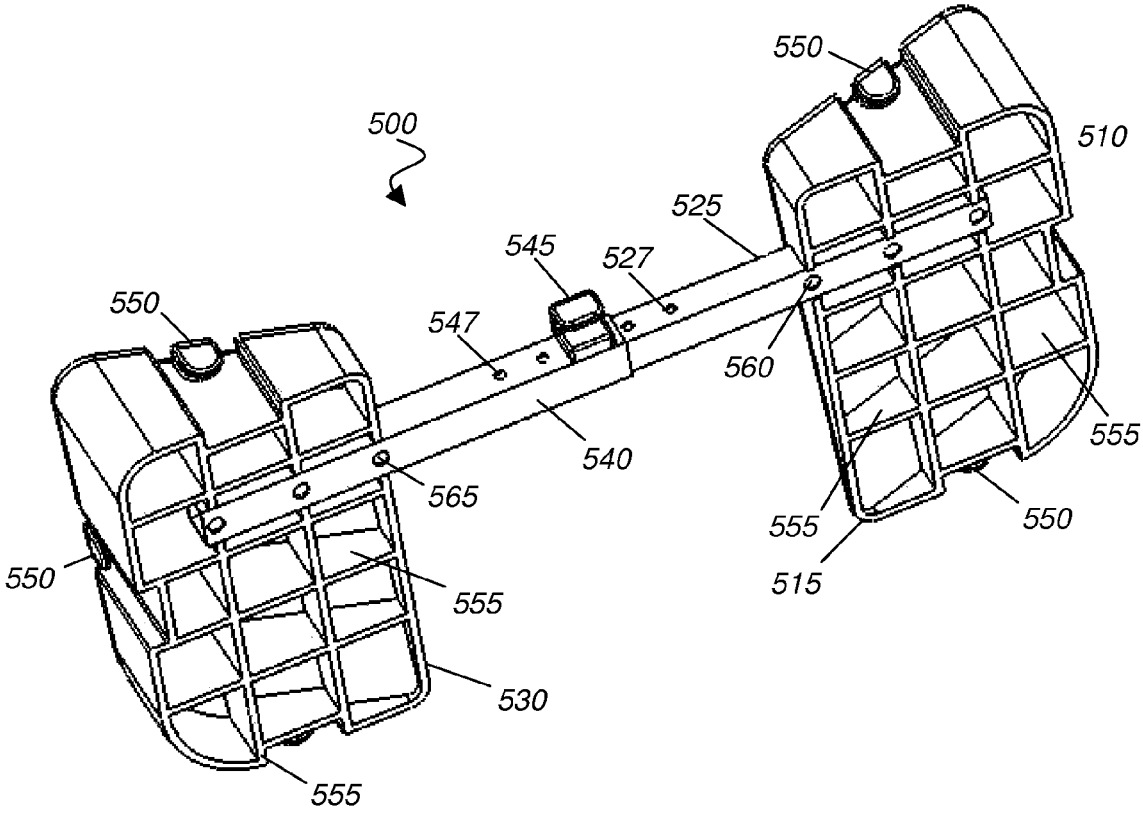

FIG. 5B shows a bottom view of an exemplary exercise platform 500 that includes a plurality of angled step surfaces with adjustable width. In some implementations, the right step 515 and left step 530 can include one or more support elements 555. The support elements 555 can add rigidity and strength to the right and left steps 515, 530 while reducing the weight and the amount of material used to manufacture the right and left steps 515, 530. Further, the right step 515 and left step 530 can be configured to include a channel or other such opening to receive at least a portion of the right and left connector bars 525, 540, respectively. Additionally, in some implementations, the right and left connector bars 525, 540 can be fastened to the right and left steps 515, 530 using one or more screws 560, 565. In some other implementations, the right and left connector bars 525, 540 can be secured to the right and left steps 515, 530 through other fasteners, such as an adhesive, one or more pins, molded features, or compression fittings.

Figure 6:
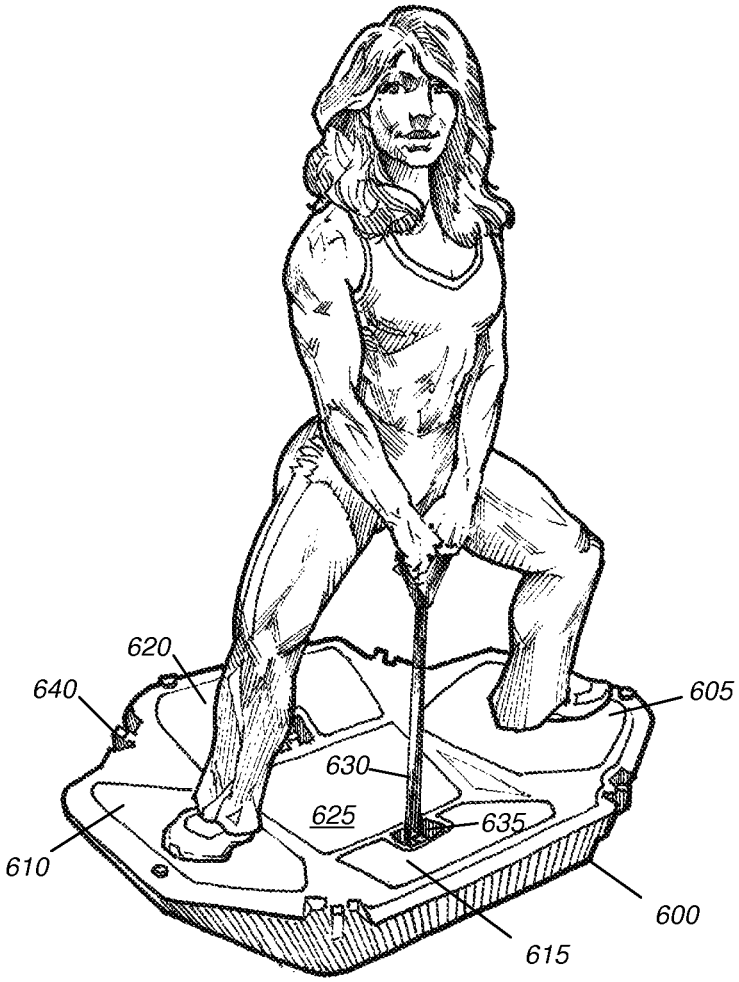
FIG. 6 shows a user positioned on an exemplary exercise platform that includes a plurality of angled step surfaces.

FIG. 6 shows a user positioned on an exemplary exercise platform that includes a plurality of angled step surfaces. The user can stand on the upper surface of the exercise platform 600 by placing their left foot on the step surface of the left step 605 and their right foot on the step surface of the right step 610. The angles of the left step 605 and the right step 610 align the user such that specific muscles or muscle groups can be targeted during the performance of one or more exercises. For example, by standing on the angled step surfaces, the user can be positioned for correct knee gait and spine neutrality, producing a safe exercise position throughout the full range of motion. Further, the user's position on the angled step surfaces of the left and right step 605 and 610, can cause the excitation of small stabilizer muscles that connect the pelvis to the legs and to the spine. Once positioned on the exercise platform 600, the user can perform one or more exercises. For example, the quadriceps can be exercised through their full range of motion by performing squats, including wide or sway squats. The angled step surfaces result in a hyper-contraction and extension on applicable and usable muscles and tendons, e.g. in the posterior legs and hips. In some implementations, the user also can position either or both feet on the step surface of the front step 615, the back step 620, or the center landing area 625. Thus, in some implementations, each and every step surface included on the exercise platform 600 can be utilized in the performance of one or more exercises.

Further, one or more resistance members also can be used to increase the resistance experienced by a user during exercise. The one or more resistance members can be coupled to a device worn by the user, e.g. a harness, or held by the user, e.g. by a handle. For example, an elastic band 630 can be attached to a center hook point 635, included in the exercise platform 600. Further, a plurality of hook points and fasteners, e.g., fastener 640, can be included on the exercise platform 600 to accommodate a variety of exercises. The one or more resistance members, e.g., the elastic band 630, can be used to increase the resistance experienced by a user performing lower body exercises, such as squats.

Alternatively or additionally, the one or more resistance members can be used to perform one or more upper body exercises, such as bicep curls, deltoid raises, or upright rows.

Thus, particular embodiments of the invention have been described. Other embodiments are within the scope of the following claims. For example, the disclosed structural elements can be arranged in different combinations and orientations. Further, additional structural elements can be included.

What is claimed is:

1. An exercise platform comprising:

a first step including a first step surface angled between 5 and 30 degrees toward a longitudinal axis bisecting the exercise platform;

a second step including a second step surface angled toward the longitudinal axis of the exercise platform by an amount substantially equal to the angle of the first step surface;

wherein the first step surface and the second step surface are further angled by a second angle between 5 and 30 degrees toward a transverse axis laterally bisecting the exercise platform, and wherein the angles of the first step surface and the angles of the second step surface are measured with respect to a plane that is substantially parallel to a bottom surface of the first step and the second step;

and a first connector bar fixedly coupled to the first step and a second connector bar fixedly coupled to the second step, the first connector bar being detachably coupled with the second connector bar.

2. The exercise platform of claim 1, further comprising: an anchor pin securing the first connector bar to the second connector bar, the anchor pin including a hook point adapted to receive a resistance member.

3. The exercise platform of claim 1, wherein: the first step includes a hook point adapted to receive a resistance member.

4. The exercise platform of claim 1, wherein: the longitudinal angle of the first step surface differs from the longitudinal angle of the second step surface by no more than 3 degrees, and the transverse angle of the first step surface differs from the transverse angle of the second step surface by no more than 3 degrees.

5. The exercise platform of claim 1, further comprising a center landing area located between the first step surface and the second step surface, wherein the center landing area is substantially parallel to the plane that is parallel to the bottom surface of the first step and the second step.

6. The exercise platform of claim 1, further comprising a center landing area located between the first step surface and the second step surface, wherein the center landing area is angled by an angle between 5 and 30 degrees toward a transverse axis laterally bisecting the exercise platform, relative to the plane that is parallel to the bottom surface of the first step and the second step.

7. The exercise platform of claim 1, further comprising a slip-resistant surface on the first and second step surfaces.

* * * * *